United States Patent [19]

Marmo

[11] 4,167,081

[45] Sep. 11, 1979

[54] CENTERLESS GRINDER

[75] Inventor: Anthony R. Marmo, Cheswick, Pa.

[73] Assignee: Westinghouse Electric Corp., Pittsburgh, Pa.

[21] Appl. No.: 813,563

[22] Filed: Jul. 7, 1977

[51] Int. Cl.[2] ..... B24B 5/22

[52] U.S. Cl. ..... 51/103 TF; 51/165.91; 51/215 AR

[58] Field of Search ..... 51/103 R, 103 WH, 103 TF, 51/215 R, 215 AR, 215 HM, 215 CP, 215 H, 215 UE, 165.91

[56] References Cited

U.S. PATENT DOCUMENTS

| | | | |
|---|---|---|---|
| 2,624,985 | 1/1953 | Happel | 51/215 H X |
| 2,720,734 | 10/1955 | Heckethorn | 51/103 WH |
| 2,979,869 | 4/1961 | Birleson | 51/103 TF X |
| 2,990,656 | 7/1961 | Tompkins | 51/103 TF |
| 3,576,189 | 4/1971 | Lorenz | 51/103 TF X |

*Primary Examiner*—Nicholas P. Godici
*Attorney, Agent, or Firm*—L. A. DePaul

[57] ABSTRACT

A centerless grinder having a feed mechanism for introducing members at a uniform rate into the grinder. The feed mechanism comprises an escapement mechanism for diverting a member such as a pellet from a stream and into the grinder along with a feed wheel with equally spaced radial wires mounted around its periphery to engage each member and push the member into the grinding wheel.

9 Claims, 7 Drawing Figures

CENTERLESS GRINDER

BACKGROUND OF THE INVENTION

This invention relates to grinding apparatus and particularly to centerless grinding apparatus having feed mechanisms for introducing members to the grinder at a uniform rate.

The core of a nuclear reactor generally comprises an array or arrays of fuel assemblies which contain fuel elements. The fuel element is generally a cylindrical metallic sheath sealed at both ends containing nuclear fuel. The nuclear fuel which may be, for example, ceramic fuel pellets of a uranium compound, is stacked within the metallic sheath. During reactor operation, the nuclear fuel pellets fission releasing fission products such as fission gas while generating heat in a manner well known in the art.

There are many known methods for manufacturing the nuclear fuel pellets used in nuclear reactors. Most of these methods generally consist of cold pressing a powder which may be an oxide of fissionable material such as uranium dioxide to form dense compacts. These dense compacts are generally referred to as green pellets. The green pellets are then sintered in a non-oxidizing atmosphere to produce a sintered pellet which may have slight irregularities on its surface. The sintered pellet may then be ground to remove those irregularities thereby forming a right cylindrical pellet. This finished pellet is then stacked within the metallic sheath to form the fuel element that may be used in a nuclear reactor.

A commonly known method for producing the nuclear fuel pellets is described in U.S. Pat. No. 2,991,601 to J. Glatter et al, issued July 11, 1961. In this process, hydrogen reduction of uranium trioxide is employed to produce uranium dioxide powder. As received from commercial manufacturers, this uranium dioxide is not free flowing and is, therefore, not adaptable for use in automatic machinery for the production of the green pellets. In order to produce a free flowing powder, the uranium dioxide powder is mixed with a suitable binder such as aluminum stearate and water to form a wet granulate. The wet granulate is then forced through a screen and dried, after which it is dry-screened thereby separating the larger particles from the smaller particles. The water may be substantially removed in the later sintering process while the aluminum stearate will remain and act as a lubricant in the compacting process. Once the uranium dioxide powder has thus been converted into a free flowing granulate, the granulate is then compacted into green pellets in a cold pressing operation. The compacting process comprises flowing the granulate into a die and cold pressing the granulate in the die into substantially cylindrical green pellets. The green pellets may then be heat treated, sintered and ground to form the finished pellet for use in nuclear fuel elements.

During the sintering step in the manufacture of the nuclear fuel pellet, the pellet may shrink nonuniformly into a shape resembling an hour glass. A grinding process is then used to restore the cylindrical shape of the pellet. One known method of grinding fuel pellets comprises collecting the pellets in a vibratory bowl type pellet feeder, vibrating the pellets down a trough to the entrance of a centerless grinder where the pellets are ground to a proper shape. There are several problems associated with this concept. For example, the rate of vibration of the bowl type feeder changes with the changing pellet mass in the bowl thereby changing the feed rate. In addition, vibratory feeding results in sporadic pellet flow through the grinding apparatus resulting in various numbers of pellets in the grinder at any one time. The differing number of pellets present in the grinder causes uneven grinding pressure to be exerted on the pellets which results in nonuniformity of the pellets. It is, therefore, desirable to have a pellet feeder that separates the pellet stream and feeds pellets one at a time with each pellet having the same timing and velocity as it enters the grinding wheel. This would result in the same number of pellets being present in the grinding apparatus at all times thus allowing uniform grinding.

SUMMARY OF THE INVENTION

A centerless grinder having a feed mechanism for introducing members at a uniform rate into the grinder. The feed mechanism comprises an escapement mechanism for diverting a member such as a pellet from a stream and into the grinder along with a feed wheel with equally spaced radial extensions mounted around its periphery to engage each member and push the member into the grinding apparatus. The grinder may further comprise a lubricating system for applying a lubricant to the grinding apparatus along with a drying device for removing moisture from the members. In addition, the grinder may further comprise an inspection mechanism for determining if the ground member is within predetermined limits and for rejecting nonconforming members.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings, wherein:

DESCRIPTION OF THE PREFERRED EMBODIMENT

In the manufacture of nuclear fuel pellets it is desirable to have uniformity among the pellets, especially in the pellet diameter. The invention described herein provides a mechanism for increasing the uniformity among the pellets.

Figure 1:
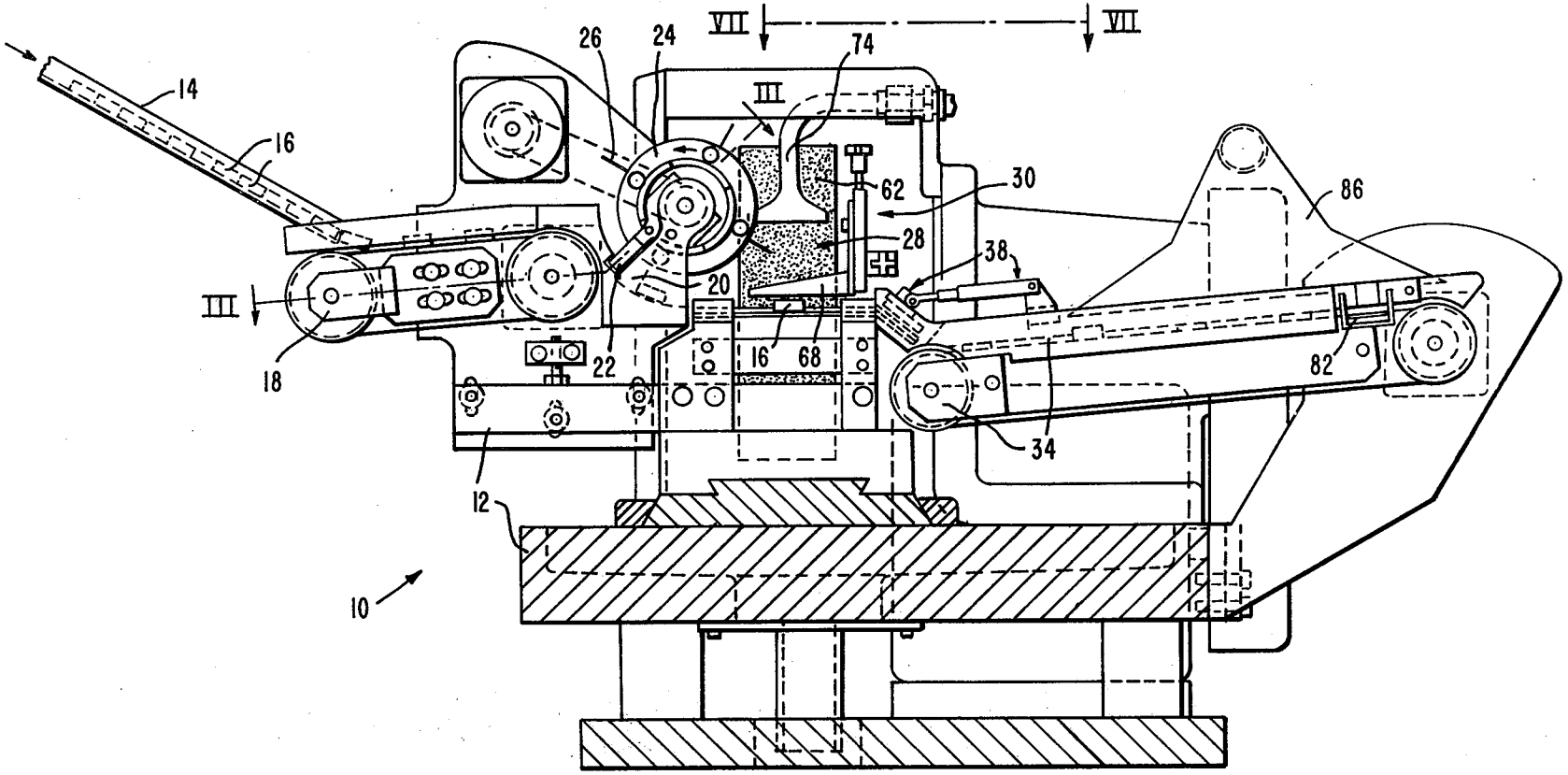
FIG. 1 is a view in elevation of the grinder.
Figure 2:
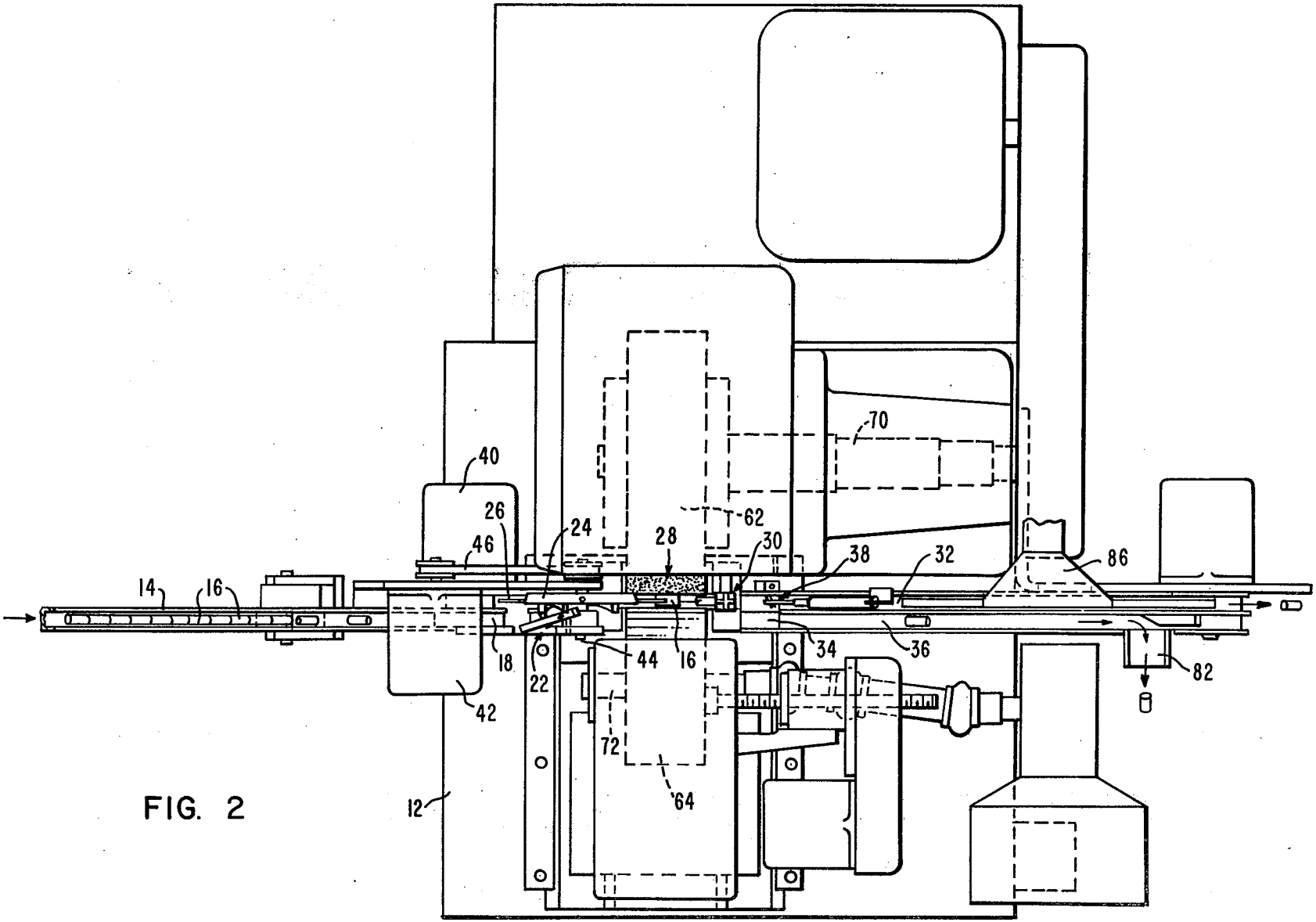
FIG. 2 is a plan view of the grinder.
Figure 3:
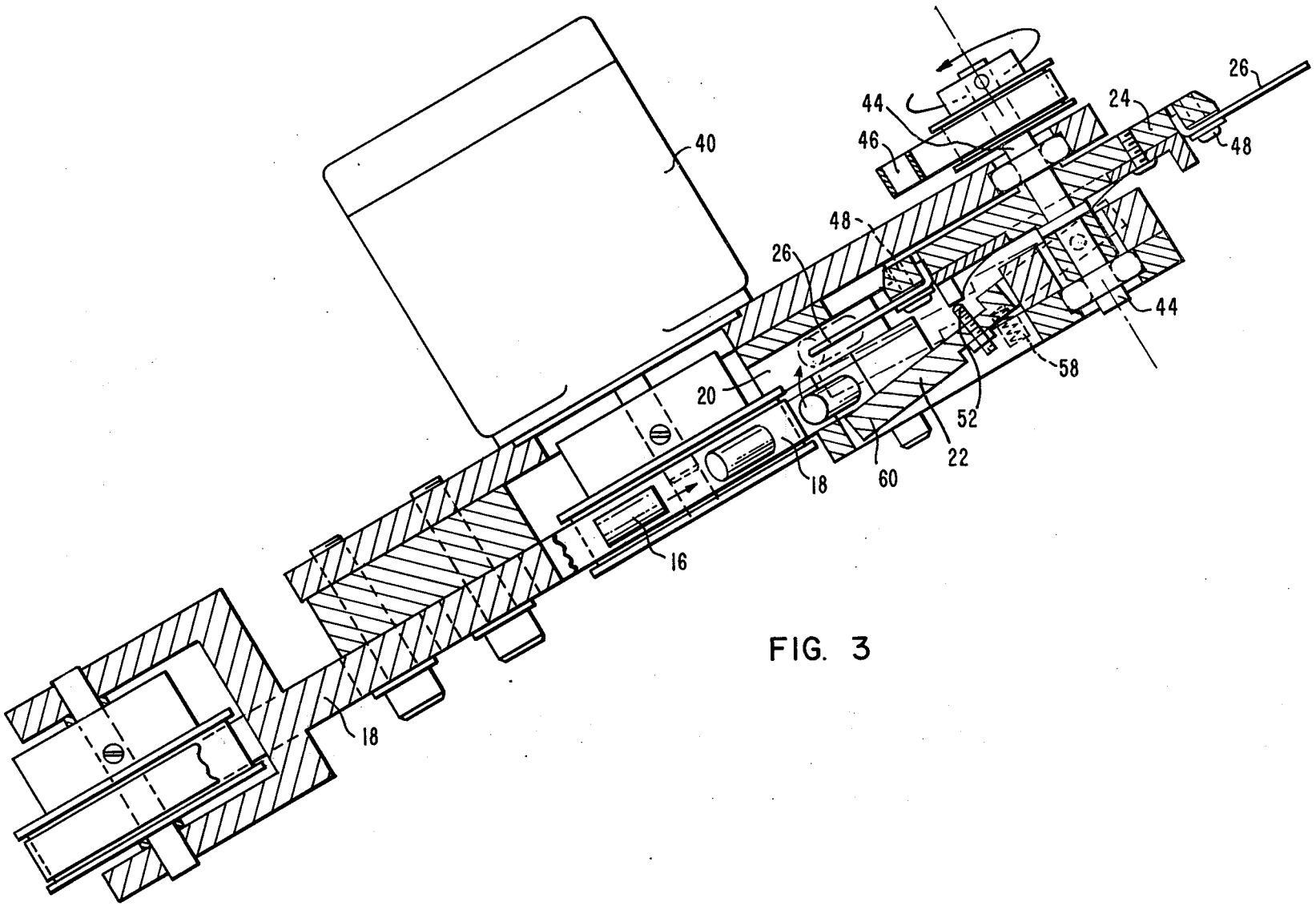
FIG. 3 is a view along line III—III of FIG. 1.

Referring to FIGS. 1 and 2, a centerless grinder referred to generally as 10 has a housing 12 for supporting the grinding and related apparatus. A feed chute 14 is arranged to deliver members such as nuclear fuel pellets 16 that have been sintered to centerless grinder 10. Feed chute 14 transports pellets 16 to a first conveyor 18 which transports pellets 16 to near an entrance chute 20. When pellets are near entrance chute 20, an escapement mechanism 22 diverts a single pellet from the pellet stream on first conveyor 18 and transfers the pellet to entrance chute 20. A feed wheel 24 associated with escapement mechanism 22 and having radial extensions around its periphery which may be wires 26 rotates about its attachment so that the end of a wire 26 contacts the end of the pellet that has been diverted by escapement mechanism 22 and pushes the pellet through entrance chute 20. Entrance chute 20 terminates near the entrance to grinding apparatus 28. Feed wheel 24 continues to advance the pellet through grinding apparatus 28 where the pellet is ground to the proper size. As the pellet exits grinding apparatus 28 an inspection mechanism 30 determines whether or not the pellet is conforming to predetermined dimensional limits. The conforming pellets are transported through a first exit chute 32 by a second conveyor 34 to the next process station for the pellet. On the other hand, the nonconforming pellets are diverted into a second exit chute 36 by diverting mechanism 38 where they are carried by second conveyor 34 to a scrap hopper (not shown).

Figure 4:
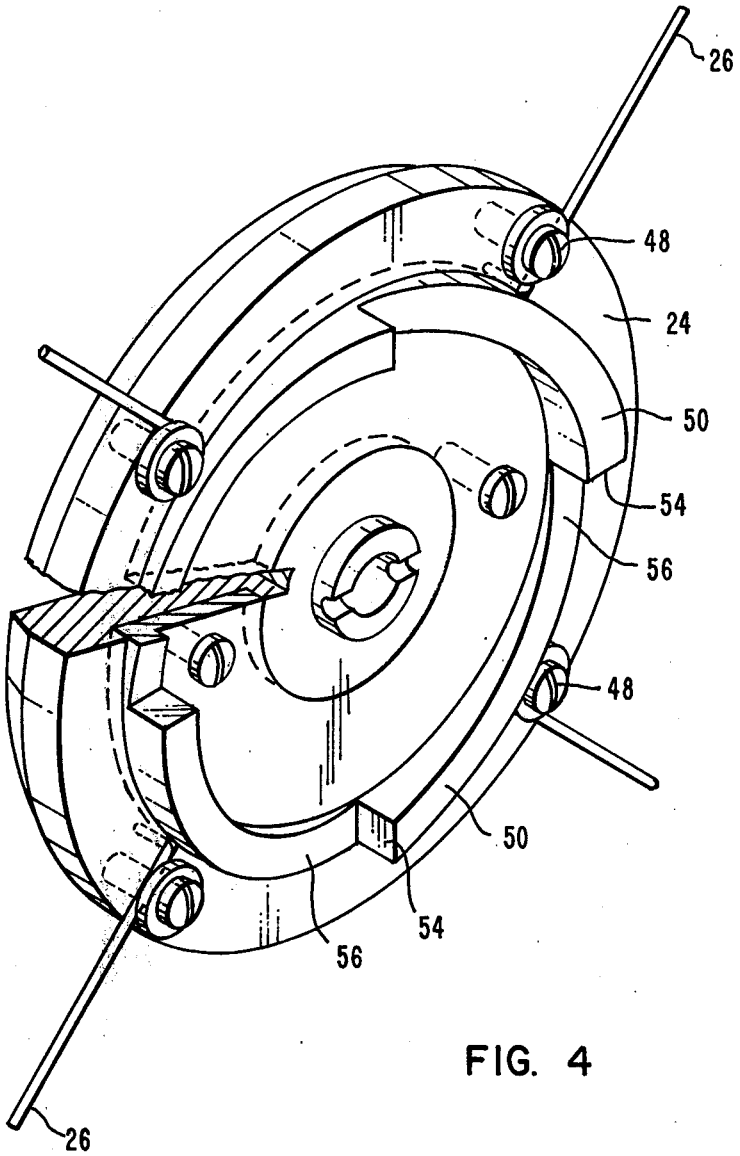
FIG. 4 is a view in perspective of the feed wheel.

Referring now to FIGS. 1 through 4, conveyor 18 which may be chosen fron those well known in the art may be driven by first motor 40 while a similar second motor 42 mounted on housing 12 may be arranged to drive escapement mechanism 22 and feed wheel 24. Second motor 42 may be connected to axle 44 by means of a belt 46. Feed wheel 24 is mounted on axle 44 above entrance chute 20 so that when belt 46 rotates axle 44 under the action of second motor 42 feed wheel 24 will rotate causing wires 26 to contact an end of a pellet 16 in entrance chute 20 and push the pellet through entrance chute 20. Wires 26 may be mounted on feed wheel 24 by means of bolts 48. Escapement mechanism 22 is mounted around axle 44 and in alignment with first conveyor 18 such that escapement mechanism 22 does not rotate with axle 44. Feed wheel 24 has a camming surface 50 which may be divided into several individual surfaces corresponding to the number of radial extensions such as wires 26 as shown in FIG. 4. Escapement mechanism 22 has a pin 52 mounted thereon in a position to correspond to camming surfaces 50 such that as feed wheel 24 rotates on axle 44, pin 52 will follow a camming surface 50 causing escapement mechanism 22 to be pivoted about axle 44 and out of the plane of first conveyor 18. Pin 52 will continue to follow camming surface 50 thereby gradually pivoting escapement mechanism 22 until it reaches the end of a camming surface such as a step 54. When pin 52 encounters a step 54, pin 52 is forced down to a position such as position 56 by biasing mechanism 58 mounted on housing 12 which may be a spring chosen from those well known in the art. From position 56, pin 52 once again follows the next camming surface 50. The action of biasing mechanism 58 and pin 52 causes first end 60 of escapement mechanism 22 to contact a pellet on first conveyor 18 which causes the pellet to be diverted from first conveyor 18 to entrance chute 20. The placement of wires 26 on feed wheel 24 is such that wires 26 correspond to steps 54 so that when a pellet is diverted into entrance chute 20 a wire 26 is arranged to contact the end of the pellet and push it through entrance chute 20 and through grinding apparatus 28 thereby assuring that a uniform grinding pressure is applied to all pellets. A uniform grinding pressure results in uniform pellet diameters.

Figure 6:
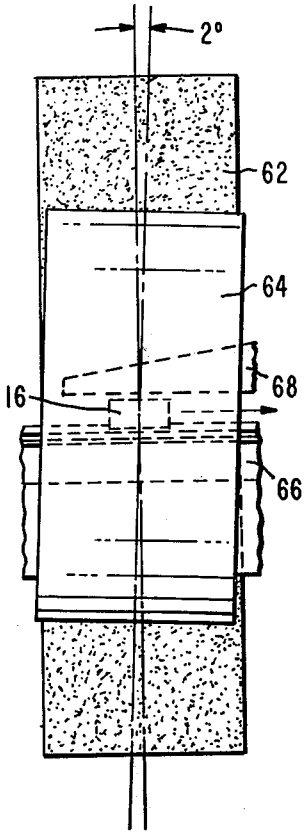
FIG. 6 is a side view of the grinding apparatus; and,
FIG. 7 is a view along line VII—VII of FIG. 1.
Figure 5:
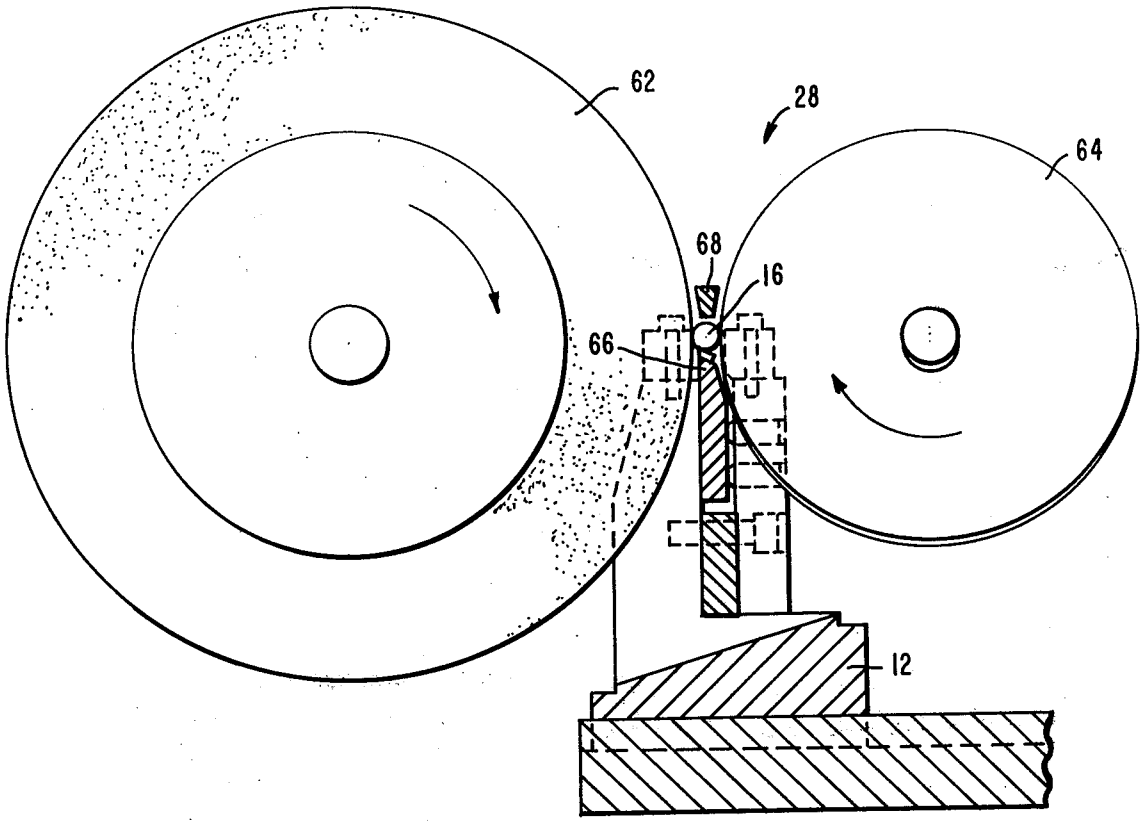
FIG. 5 is an end view of the grinding apparatus.

Referring now to FIGS. 1, 2, 5 and 6, a grinding apparatus 28 comprises a grinding wheel 62, a regulator wheel 64 a mounting blade 66 and a guide member 68. Grinding wheel 62 which may be chosen from those well known in the art is disposed on a first shaft 70 which is mounted in a motor for rotating grinding wheel 62 in a direction as indicated in FIG. 5 while regulator wheel 64 is mounted on a second shaft 72 which is also mounted in a motor for rotating regulator wheel 64 in a direction as indicated in FIG. 5. Regulator wheel 64 is inclined from the vertical by approximately two degrees as shown in FIG. 6 so that a pellet that has been introduced into grinding apparatus 28 by feed wheel 24 will continue therethrough under the action of regulator wheel 64. The pellet in grinding apparatus 28 rests on a sharp mounting blade 66 so that the pellet will be held in place for grinding along a narrow line defined by the blade edge. In addition, a guide member 68 is disposed above the pellet and mounting blade 66 to prevent the pellet from being ejected from the grinding apparatus 28. The action of grinding wheel 62 along with regulator wheel 64 and mounting blade 66 causes the pellet to be ground to a uniform diameter thus eliminating irregularities on its surface such as the hourglass configuration that may have been present due to the sintering process. In addition, lubricant applicator 74 serves to provide a lubricant such as silicone to lubricate grinding apparatus 28.

Figure 7:
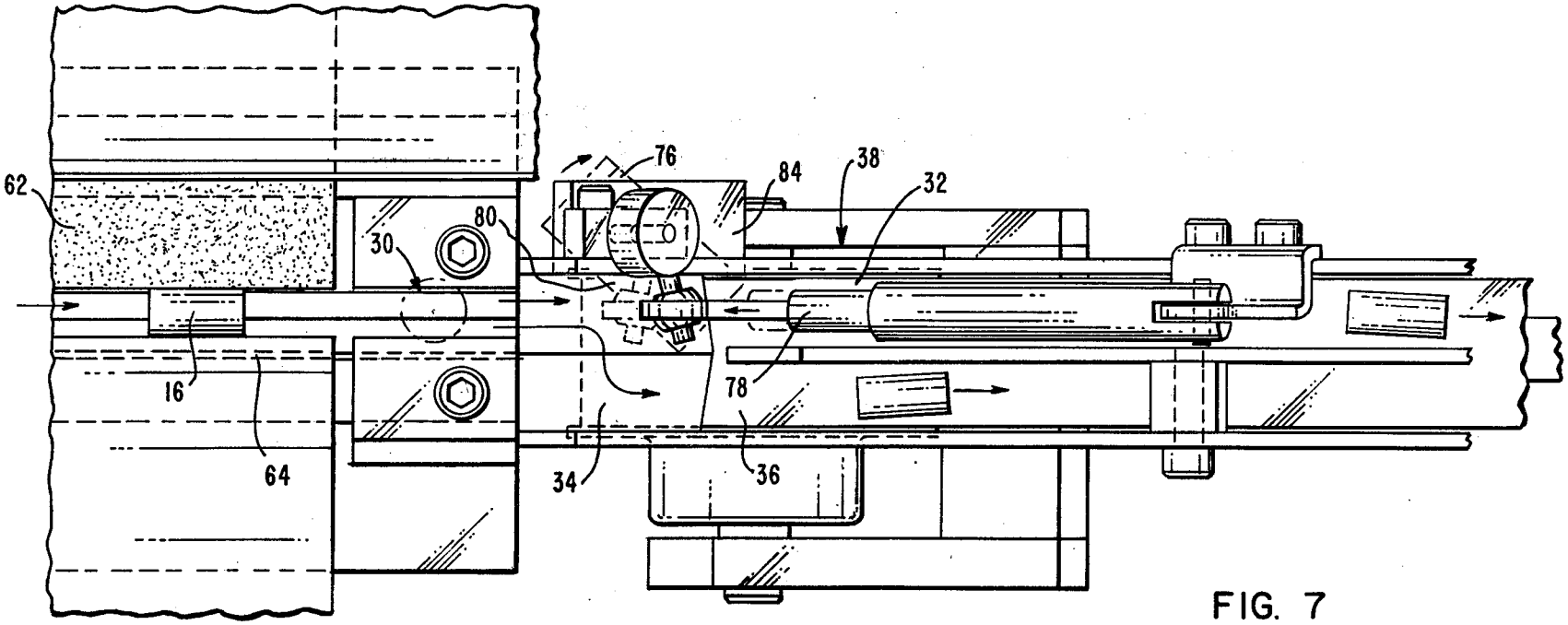

Referring now to FIGS. 1, 2 and 7, as the ground pellet exits grinding apparatus 28 it encounters an inspection mechanism 30 which may be an air gauge chosen from those well known in the art. As the pellet passes beneath the air orifice of the air gauge, the air gap between the orifice and the pellet produces a back pressure in the air gauge. A change in diameter of the pellets results in a change in back pressure in the gauge which is translated into a diameter reading. Thus, by monitoring the back pressure, the diameter of the pellet can be determined. The pellet then proceeds on to second conveyor 34 in first exit chute 32. Should inspection mechanism 30 determine the pellet to be nonconforming, diverting mechanism 38 is activated. Diverting mechanism 38 may comprise a plate 76, pivotally mounted on housing 12 along with pneumatic piston 78. When diverting mechanism 38 is activated, pneumatic piston 78 is extended which causes plate 76 to be pivoted into first exit chute 32 indicated by position 80 in FIG. 7. The pellet moving on second conveyor 34 in first exit chute 32 contacts plate 76 and is diverted into second exit chute 36. The nonconforming pellet in second exit chute 36 proceeds on second conveyor 34 which extends under both exit chutes 32 and 36 to exit port 82 where the pellet may fall into a scrap hopper (not shown). On the other hand, when a conforming pellet enters first exit chute 32, diverting mechanism 38 is not activated and plate 76 remains in a position indicated by 84 in FIG. 7, thus not contacting the pellet in first exit chute 32. The pellet in first exit chute 32 then proceeds on second conveyor 34 to the next work station which may be a station for loading the fuel pellets into a nuclear fuel rod for use in a nuclear reactor. Also, a drying hood 86 may be disposed over second conveyor 34 for removing moisture from the ground pellets.

OPERATION

In operation, pellets 16 that may have come from a sintering process are transported by means of a feed chute 14 to first conveyor 18 which transports the pellets to near entrance chute 20. With a pellet near entrance chute 20, pin 52 of escapement mechanism 22 reaches a step 54 which causes first end 60 to divert a pellet into entrance chute 20. A wire 26 of feed wheel 24 then contacts the pellet in entrance chute 20 and pushes the pellet through entrance chute 20 and into grinding apparatus 28. Grinding apparatus 28 causes the pellet to be ground to a uniform diameter and causes the pellet to be advanced to inspection mechanism 30 where the diameter of the pellet may be measured. Conforming pellets proceed on second conveyor 34 through first exit chute 32 to the next work station while nonconforming pellets are diverted by diverting mechanism 38 into second exit chute 36 where the pellet proceeds to a scrap hopper. In addition, drying hood 86 may be used to remove moisture from the pellets on second conveyor 34. Thus, the invention provides a centerless grinder having an escapement mechanism for feeding members into the grinder at a uniform rate along with an inspection device for determining dimensional characteristics of the pellets.

I claim as may invention:

1. A centerless grinder for grinding members to a uniform dimension comprising:

a housing;

a grinding wheel mounted on said housing for grinding said members;

a regulator wheel mounted on said housing in opposition to said grinding wheel such that an axis of rotation of said regulator wheel is not parallel to an axis of rotation of said grinding wheel for advancing said members therebetween;

a mounting blade arranged between said grinding wheel and said regulator wheel for supporting said members as said members are ground;

a feed mechanism for advancing said members toward said mounting blade;

an axle;

a feed wheel having radial extensions about its periphery and having a camming surface and being mounted on said axle for advancing said members to said mounting blade; and an escapement mechanism pivotally mounted around said axle and having a pin mounted therein for following said camming surface, said escapement mechanism diverting said members from said feed mechanism to near said feed wheel where said radial extension contacts an end of said member and advances said member to said mounting blade at a uniform rate.

2. The centerless grinder according to claim 1 wherein said escapement means further comprises:

biasing means attached to said escapement mechanism for urging said pin against said camming surface.

3. The centerless grinder according to claim 2 wherein said centerless grinder further comprises:

an inspection mechanism disposed on said housing and near said mounting blade for determining the physical dimensions of said member as said member leaves said mounting blade.

4. The centerless grinder according to claim 3 wherein said centerless grinder further comprises:

diverting means disposed on said housing near said inspection mechanism for diverting said members to a scrap hopper when said inspection mechanism indicates that said members are nonconforming and for allowing said members to pass through when said inspection mechanism indicates that said members are conforming.

5. The centerless grinder according to claim 4 wherein said centerless grinder further comprises:

a drying hood attached to said housing and near said diverting means for removing moisture from said members as said members pass by.

6. The centerless grinder according to claim 5 wherein said feed mechanism comprises:

a first conveyor for delivering said members to said escapement means.

7. The centerless grinder according to claim 6 wherein said diverting means comprises:

a second conveyor mounted on said housing near said mounting blade for transporting said members;

a plate pivotally attached to said housing and over said second conveyor for being pivoted over said second conveyor thereby diverting said members contacting said plate; and a piston-cylinder mechanism attached to said plate for selectively pivoting said plate about its attachement.

8. The centerless grinder according to claim 7 wherein said inspection mechanism comprises:

an air gauge mounted on said housing for determining the diameter of said members.

9. The centerless grinder according to claim 8 wherein said centerless grinder further comprises:

lubricating means attached to said housing for supplying a lubricant to the grinding apparatus.

* * * * *